US006142803A

United States Patent [19]

Bozzer et al.

[11] Patent Number: 6,142,803

[45] Date of Patent: Nov. 7, 2000

[54] COAXIAL ANTENNA CONNECTOR FOR MOBILE PHONE

[75] Inventors: Dieter Bozzer, Bex; Sébastien Kempter, Aigle; Blaise Rithener, Vevey; Lionel Thomas, Bramois, all of Switzerland

[73] Assignee: The Whitaker Corporation, Wilmington, Del.

[21] Appl. No.: 09/209,035

[22] Filed: Dec. 10, 1998

[30] Foreign Application Priority Data

Dec. 22, 1997 [CH] Switzerland ..... 97122616

[51] Int. Cl.[7] ..... H01R 29/00

[52] U.S. Cl. ..... 439/188; 439/916

[58] Field of Search ..... 439/188, 944, 439/63, 79, 581, 578, 916; 200/51.1, 51.09; 343/702

[56] References Cited

U.S. PATENT DOCUMENTS

| | | | |
|---|---|---|---|
| 5,145,382 | 9/1992 | Dickirson | 439/63 |
| 5,180,315 | 1/1993 | Nagashima | 439/581 |
| 5,688,130 | 11/1997 | Huang | 439/79 |
| 5,936,581 | 8/1999 | Roshitsh et al. | 343/702 |
| 5,944,546 | 8/1999 | Miyake et al. | 439/188 |

FOREIGN PATENT DOCUMENTS

| | | | |
|---|---|---|---|
| 2 222 493 | 5/1988 | European Pat. Off. | H01R 27/00 |
| 0 647 985 | 4/1995 | European Pat. Off. | H01R 9/05 |
| 0 722 202 | 7/1996 | European Pat. Off. | H01R 13/434 |
| 94 19 989 U | 12/1994 | Germany | H01R 13/06 |
| WO 97/18603 | 5/1997 | WIPO | H01R 17/12 |
| WO 98/43323 | 10/1998 | WIPO | H01R 17/12 |

*Primary Examiner*—Neil Abrams
*Assistant Examiner*—Michael C. Zarroli

[57] ABSTRACT

A mobile phone coaxial connector assembly comprises a switching coaxial connector for connection to an external antenna, and a second coaxial connector for connection to an internal antenna. The switching connector and internal antenna connector are provided with a common dielectric housing such that the connectors form a single assembly. The internal antenna connector comprises a resiliently mounted center contact having a large dome-shaped contact surface for positional tolerance absorption.

13 Claims, 3 Drawing Sheets

COAXIAL ANTENNA CONNECTOR FOR MOBILE PHONE

BACKGROUND OF THE INVENTION

1. Field of the Invention

This invention relates to a coaxial connector for interconnecting the antenna of a mobile phone to circuitry thereof.

2. Description of the Prior Art

Mobile phones comprise their own antennas but when the phone is positioned on a support in a automobile for example, the phone connects to the automobile antenna. The connection of the mobile phone to the automobile antenna requires a switch to disconnect the phone from its antenna. The connector for connection to the external antenna is typically a coaxial type of connector having an inner conductor concentrically surrounded by a ground conductor.

An example of a coaxial switching connector assembly is shown in European application 685 911 A1. The switch function is accomplished by provision of a spring loaded bush mounted concentrically around a coaxial center pin conductor and biased against a conductor pad. Disconnection between the center pin and conductor pad occurs during plugging of the complementary connector which depresses the concentric bush member. One of the problems of the latter design and other coaxial connectors, is that they are not adapted to absorb relatively large tolerances in position of the mating parts. This is particularly important in applications such as cell phones, where in comparison to the connector size, the positioning of the cell phone in its support (cradle) may vary significantly. Another problem arises from the frequent plugging and unplugging and relatively large shocks and forces to which contacts are subject.

It would be desirable to provide a coaxial connector interface that supports high mechanical solicitation and a large number of connection cycles in a compact and cost-effective manner.

In conventional designs it is typical to interconnect, via circuit traces on the cell phone PCB, the center conductor that is switched by the external antenna connector, to an antenna mounted in the phone. The connection between the antenna and PCB requires a further connection device. One of the problems of conventional interconnections between the antenna and the coaxial switching connector is the relatively poor electrical performance and the plurality of components that increase manufacturing and assembly costs. Tolerances in the positioning of the antenna relative to the printed circuit board may be fairly large. It would be advantageous to provide a connection system to the antenna that allows for large positional tolerances without diminishing the electrical performance.

SUMMARY OF THE INVENTION

It is an object of this invention to improve the interconnection between antennas and a mobile phone.

Objects of this invention have been achieved by providing the connector according to claim 1. Disclosed herein is a coaxial connector assembly comprising a first coaxial connector for mating pluggably with a complementary coaxial external antenna connector, the first connector comprising an inner contact matable with a center conductor of the complementary connector, the inner contact comprising a switch for disconnecting an internal antenna from circuitry of the mobile phone when the complementary connector is plugged with the first connector, wherein the assembly further comprises a second coaxial internal antenna connector integrally formed with the first connector for connection to the internal antenna.

The second coaxial connector may comprise an inner conductor resiliently biasable against the antenna. A spring element for resiliently biasing the inner contact may be integrally formed with a portion of the switch. The spring element and portion of switch may be stamped and formed from sheet metal for a particularly cost-effective and reliable design. The assembly may comprise a dielectric housing formed of an integral part, for example by moulding, to which the inner and outer contacts of the assembly are securely fastened. A single assembly that can be easily handled and connected to a printed circuit board, and that allows interconnection of an internal or an external antenna via the switching coaxial connector is thus provided. A particularly cost-effective and reliable antenna connection is thus achieved. The second coaxial connector for the internal antenna may comprise a center contact mounted concentrically within a portion of housing, the center conductor slideably movable in an axial direction substantially perpendicular to a circuit board when the connector is mounted thereon. The second coaxial connector center contact may have an enlargened dome-shaped contact portion for adjusting to positional tolerances of the internal antenna with respect to the connector. The center contact may be machined from solid metal.

The first coaxial connector may comprise a pin-shaped center contact slideable in an axial direction substantially orthogonal to a printed circuit board on which the connector is mounted, the center contact having a contact portion protruding beyond a mating face of the dielectric housing for resilient abutment against the center contact of the pluggable complementary connector. Resilient biasing of the center pin contact may be effected by a stamped and formed spring arm having a portion of the switch thereon.

Objects to this invention have been achieved by providing the connector assembly according to claim 10. Disclosed here is a coaxial connector assembly for a mobile phone, comprising an internal antenna coaxial connector for connection to an internal antenna, the connector having a dielectric housing portion concentrically surrounding a pin-shaped center contact slideably mounted in an axial direction (A) within a cavity of the housing portion for absorbing positional tolerances of the antenna in the axial direction, the assembly further comprising a spring member engaging a connection end of the center contact such that a contact surface of the center contact is biased axially away from a mating face of the dielectric housing portion, wherein the contact surface has a large dome-shape having a diameter substantially greater than the portion of pin-shaped center contact positioned within the cavity of the housing portion in order to absorb tolerances in positioning an antenna in a radial direction (R) substantially orthogonal to the axial direction (A).

Further advantageous aspects of this invention are set forth in the claims, or will be apparent from the following description and drawings.

DETAILED DESCRIPTION OF THE PREFERRED EMBODIMENT

Figure 1:
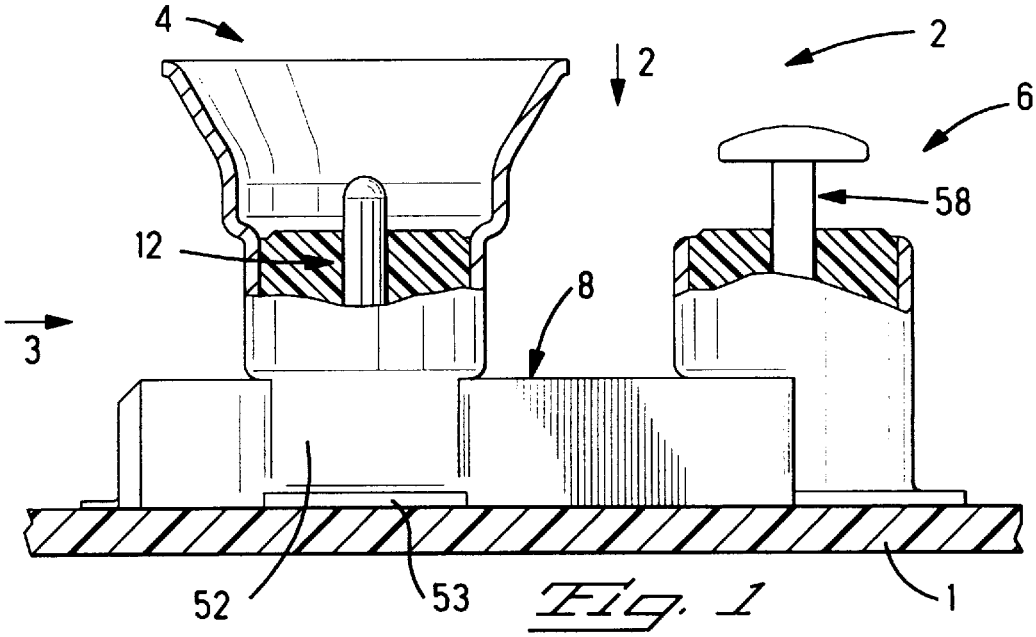
FIG. 1 is a partial cross-sectional side view of an assembly according to this invention mounted on a printed circuit board.

Referring to FIGS. 1–6, a coaxial connection assembly 2 for connecting an internal 70 or external antenna to a mobile phone, is mountable on a circuit board (PCB) 1 of the mobile phone. The assembly 2 comprises a first coaxial connector 4 (or switching connector) and a second coaxial connector 6 (or internal antenna connector) that are formed together in a single assembly. The assembly 2 has a common dielectric housing 8 (see FIG. 5) to which conductive contacts of the connectors 4, 6 are securely mounted.

Figure 2:
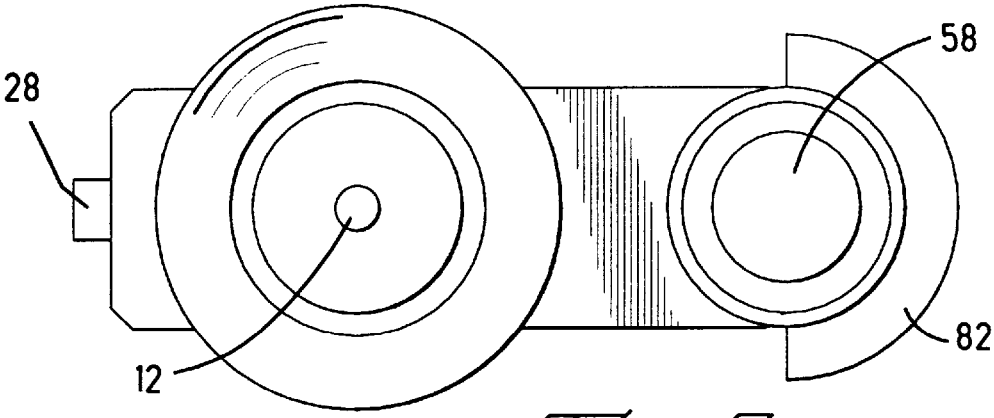
FIG. 2 is a view in the direction of arrow 2 of FIG. 1.
Figure 3:
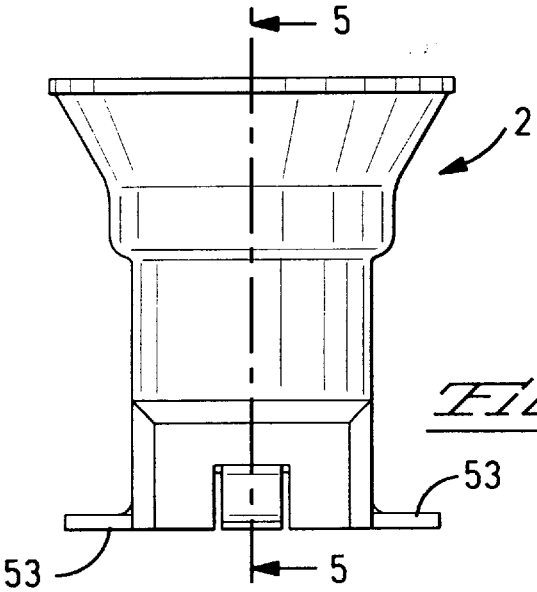
FIG. 3 is a view in the direction of arrow 3 of FIG. 1.
Figure 4:
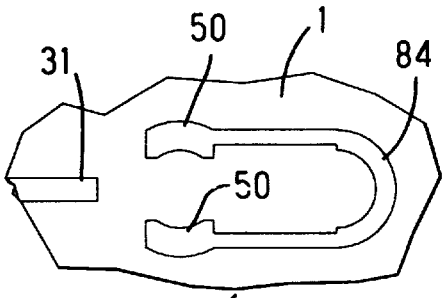
FIG. 4 is a partial top view of the layout of circuit traces on the printed circuit board, for connection to the connector assembly.
Figure 5:
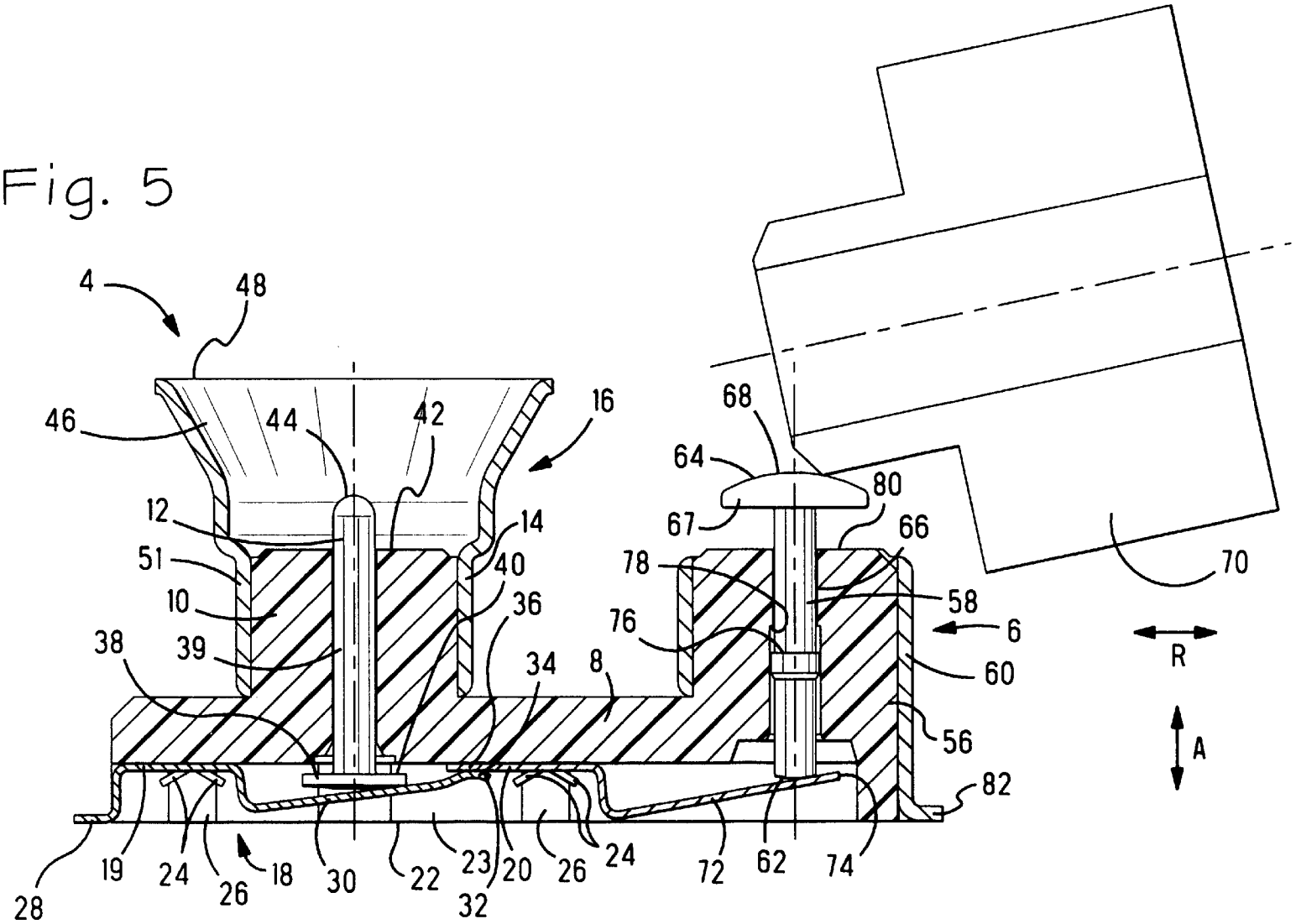
FIG. 5 is a cross-sectional view through lines 5—5 of FIG. 3 showing an internal antenna connected to the connector assembly.
Figure 6:
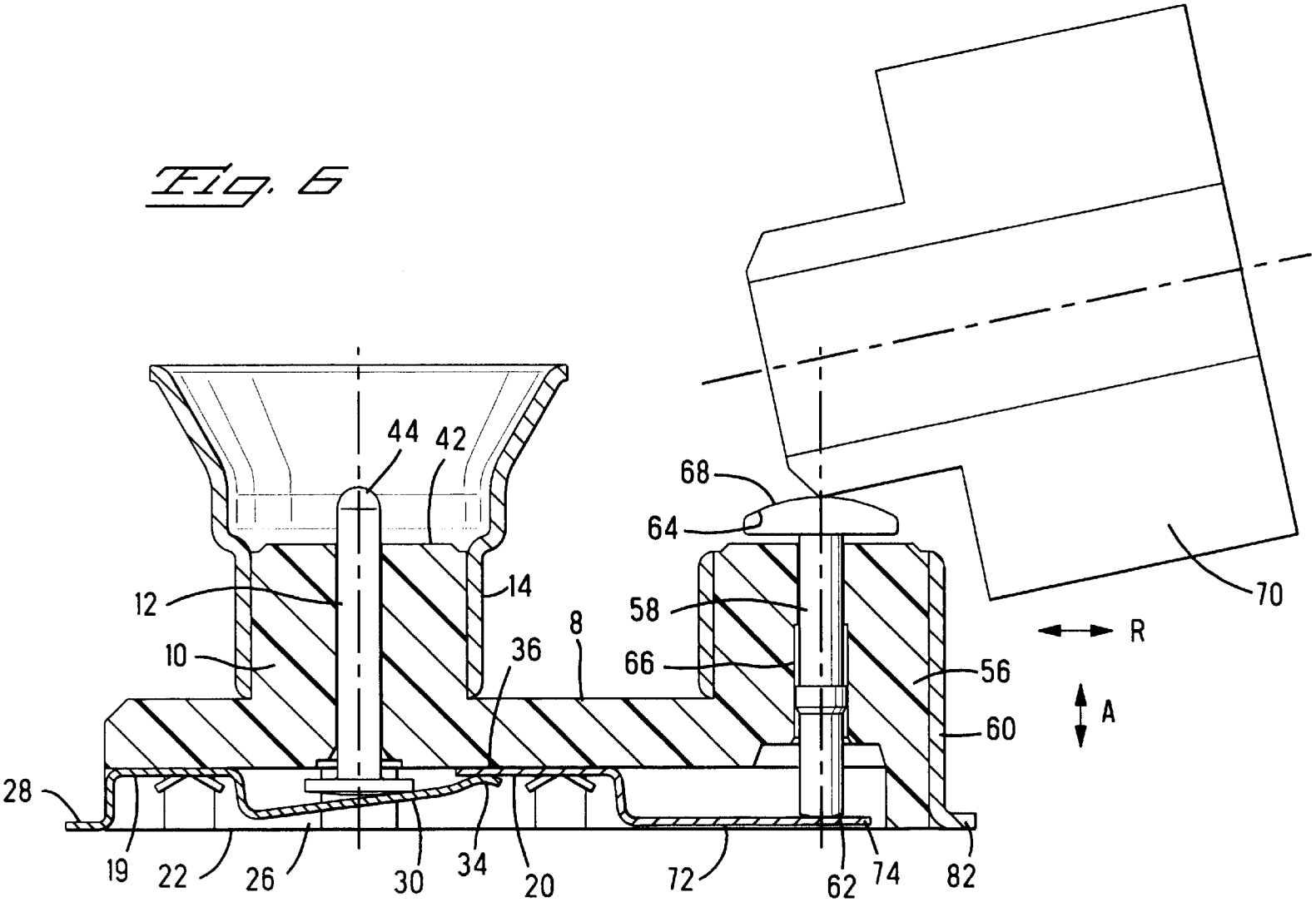
FIG. 6 is view similar to FIG. 5 but showing the internal antenna in a different position due to positional tolerances.

Referring mainly to FIGS. 5 and 2, the switching connector 4 comprises a dielectric housing portion 10, which is part of the housing 8, within which is axially slideably mounted a center contact 12, and mounted concentrically therearound is an outer contact 14. The connector 4 has a mating section 16 and a connection section 18. The connection section 18 comprises a first contact leg 19 and a second contact leg 20 mounted from a connection side 22 of the housing 8 into a recess 23 extending from the mounting or connection face 22. The contact legs 19, 20 are stamped and formed from sheet metal and have retention members in the form of V-shaped barbs 24 that engage opposing walls of vertical grooves 26 in the housing, for securing the contacts 19, 20 within the recess 23.

The first contact leg 19 comprises a PCB connection portion in the form of a surface mount tab 28 for solder surface mount on the printed circuit board 1, in particular to a circuit trace 31 (see FIG. 4) thereon. The contact leg 19 further comprises a spring member in the form of a cantilever beam spring arm 30 extending from the mounting portion 24 to a free end 32. Proximate the free end 32 is a contact portion in the form of a protrusion 34 that biases against a complementary contact portion 36 of the second contact leg 20. The spring arm 30 extends across a connection end 38 of the center contact 12. The connection portion 38 is enlargened with respect to the body 39 of the pin-shaped center contact such that the connection end 38 provides an abutment 40 limiting upward biasing of the center contact 12 beyond a mating face 42 of the housing portion 10. The center pin contact 12 is depressed towards the printed circuit board when a complementary coaxial connector is plugged to the connector 4, thereby abutting a protruding contact surface 44 of the center pin contact 12. The complementary plugging connector is for example interconnected to a external antenna such as the antenna of an automobile whereby the switch contacts 34, 36 are open thereby disconnecting the internal antenna 70. The outer contact 14 of the connector 4 has a large funnel-shaped mating portion 46 having a mating end 48 protruding well beyond the pin contact surface 44 for guiding and adjusting tolerances during plugging of the complementary external antenna connector to the switching connector. The outer contact 14 is connected to circuit trace portions 50 (see FIG. 4) by extensions 52 (see FIGS. 1 and 3) integrally extending axially from the concentric portion 51 surrounding the dielectric portion 10, the extensions 52 provided with contact pads 53 for surface mount solder connection to the circuit traces 50.

The antenna connector 6 comprises a dielectric housing portion 56 forming part of the housing 8 and concentrically surrounding a center contact 58, the housing portion 56 concentrically surrounded by an outer contact 60. The center contact 58 extends from a connection end 62 to a contact end 64, and is axially slideable in an axially extending cavity 66 of the housing portion 56. The contact end 64 has an enlargened head 67 with a domed contact surface 68 against which an antenna 70 abuts. The large domed contact surface 68 enables the antenna 70 to be positioned significant tolerances with respect to the connector. As the antenna 70 is mounted to a housing of a cell phone, it is advantageous to allow for substantial tolerance in positioning between the housing and PCB mounted in the housing, in view of increasing reliability and reducing manufacturing costs. The center contact 58 is spring mounted such that relatively large tolerances in the axial direction (A) are absorbed, (the axial direction is defined as substantially perpendicular to PCB 1 on which the connector is mountable), as can be seen by comparing FIGS. 5 and 6. Thus, large tolerances in the radial direction R (substantially parallel to the plane of the PCB 1) and large tolerances in the axial direction A can be absorbed.

The resiliency of the second coaxial connector center contact is provided by a spring arm 72 abutting against the connection end 62 of the center contact 58. The spring arm 72 is integrally stamped and formed with the second contact leg 28 which is mounted in the housing recess 23. The spring arm 72 is in the form of a cantilever beam where the contact against the connection end 62 is proximate a free end 74 of the arm. The spring arm 72 also effects the electrical interconnection between the center contact 58 and the second contact leg 20 through the switch to the PCB center contact circuit trace 31. The center contact 58 comprises a retention shoulder 76 engageable with a shoulder 78 in the cavity 66 for retaining the center contact in an upwardmost position protruding beyond a mating face 80 of the dielectric housing portion 56.

The outer contact 60 of the second coaxial connector 6 is interconnected to the PCB by provision of a contact pad 82 soldered against a complementary semi-circular circuit trace 84 (see FIG. 4) that is interconnected to the outer contact circuit traces 50. The connectors 4,6 are mechanically held together by the common dielectric housing 8 such that a single connector assembly can be handled and assembled to a circuit board thereby reducing assembly costs. In addition, the secure and accurate positioning of the connector 4, 6 with respect to each other enable reliable interconnection of an internal antenna 70 or an external antenna to the circuit board 1 in a particularly cost-effective manner. Furthermore, the internal antenna connector 6 absorbs large misalignments between the internal antenna 70 and the printed circuit board by way of the enlargened dome-shaped contact surface 68 and the axially slideable center contact 58 resiliently mounted against the spring arm 72. The contact legs 19, 20 can be simply assembled into the common housing 8 by insertion into the recess 23 in a single insertion assembly.

We claim:

1. A coaxial connector assembly for a mobile communication device, such as a phone, comprising: a first coaxial connector for pluggably mating with a complementary coaxial antenna connector, the first coaxial connector having a center contact that is matable with a center conductor of the complementary coaxial antenna connector; a second coaxial connector integrally formed with the first coaxial connector for connection to an internal antenna of the mobile communication device; and, a switch that is actuated by the center contact of the first connector to disconnect the internal antenna from circuitry of the mobile phone when the complementary coaxial antenna connector is mated thereto;

the second coaxial connector having a resiliently movable center contact that is slidably mounted within a cavity of a dielectric housing portion to allow movement in an axial direction that is orthogonal to a PCB upon which the coaxial connector assembly is to be mounted where the resiliency is provided to the movable center contact of the second coaxial connector by a separate spring arm that engages the center contact of the second coaxial connector, where the spring arm is stamped and formed from sheet metal and includes a second contact leg that is a portion of the switch.

2. The assembly of claim 1, wherein the second coaxial connector comprises a center contact that is resiliently movable in an axial direction that is orthogonal to a PCB on which the coaxial connector assembly is to be mounted.

3. The assembly of claim 2 wherein the internal antenna connector center contact is slideably mounted in a cavity of a dielectric housing portion, whereby resiliency is provided by a separate spring arm engaging the center contact.

4. The assembly of claim 3 wherein the spring arm is stamped and formed from sheet metal.

5. The assembly of claim 4 wherein the spring arm is integrally formed with a second contact leg having a portion of the switch.

6. The assembly of claim 1 wherein the internal antenna connector center contact has a large dome-shaped contact surface for abutment against the internal antenna.

7. The assembly of claim 1 wherein the first connector has a dielectric housing portion and the second connector has a dielectric housing portion, the housing portions integrally formed in a common dielectric housing to which contacts are securely mounted.

8. The assembly of claim 1 wherein the first coaxial connector comprises a center contact mounted slidably in an axial direction corresponding to that of the center contact of the second coaxial connector, the center contact of the first coaxial connector having a contact surface projecting beyond a mating face of a dielectric housing portion for abutment against the complementary coaxial antenna connector.

9. The assembly of claim 8 wherein the first connector center contact engages a spring arm that comprises a portion of the switch.

10. A coaxial connector assembly for a mobile phone, comprising an internal antenna coaxial connector for connection to an internal antenna, the connector having a dielectric housing portion concentrically surrounding a pin-shaped center contact slideably mounted in an axial direction within a cavity of the housing portion for absorbing positional tolerances of the antenna in the axial direction, the assembly further comprising a spring member engaging a connection end of the center contact such that a contact surface of the center contact is biased axially away from a mating face of the dielectric housing portion, wherein the contact surface has a large dome-shape having a diameter substantially greater than the portion of pin-shaped center contact positioned within the cavity of the housing portion in order to absorb tolerances in positioning an antenna in a radial direction substantially orthogonal to the axial direction.

11. The assembly of claim 10 wherein the spring member is a spring arm stamped and formed from sheet metal and engages a connection end of the center contact opposed to the contact surface.

12. The assembly of claim 11 wherein the spring member is integrally formed with a second contact leg comprising a portion of switch for disconnecting the internal antenna.

13. A coaxial connector assembly for a mobile communication device, such as a phone, comprising: a first coaxial connector for pluggably mating with a complementary coaxial antenna connector, the first coaxial connector having a center contact that is matable with a center conductor of the complementary coaxial antenna connector; a second coaxial connector integrally formed with the first coaxial connector for connection to an internal antenna of the mobile communication device; and a switch that is actuated by the center contact of the first coaxial connector to disconnect the internal antenna from circuitry of the mobile phone when the complementary coaxial antenna connector is mated thereto, characterized in that the second coaxial connector includes an internal antenna center contact that has a large dome-shaped contact surface for abutment against the internal antenna.

* * * * *